United States Patent [19]

Henderson et al.

[11] Patent Number: 4,701,226

[45] Date of Patent: Oct. 20, 1987

[54] CORROSION RESISTANT AMORPHOUS CHROMIUM-METALLOID ALLOY COMPOSITIONS

[75] Inventors: Richard S. Henderson, Solon; Gary A. Shreve, Euclid; Michael A. Tenhover, Solon, all of Ohio

[73] Assignee: The Standard Oil Company, Cleveland, Ohio

[21] Appl. No.: 755,250

[22] Filed: Jul. 15, 1985

[51] Int. Cl.[4] ..... C22C 27/06

[52] U.S. Cl. ..... 148/403; 420/428

[58] Field of Search ..... 148/403; 420/428

[56] References Cited

PUBLICATIONS

Ruf et al, Journal of Applied Physics, vol. 54, No. 10, pp. 5705-5710, Oct. 1983.

Naka et al, Journal of Non-Crystalline Solids, vol. 31, pp. 355-365, 1979.

Masumoto et al, Annual Review of Material Science, vol. 8, pp. 215-233, 1978.

Glassy Metals; Magnetic, Chemical, and Structural Properties, Chapter 8, Hashimoto et al, CRC Press, Inc. 1983.

*Primary Examiner*—R. Dean

*Attorney, Agent, or Firm*—Sue E. Phillips; Joseph G. Curatolo; Larry W. Evans

[57] ABSTRACT

Amorphous chromium-metalloid alloys exhibiting corrosion resistance in acid environments are described. The alloys contain a relatively low amount of a metalloid selected from the group of B, C, P, N, S, Sb and As. Additional metalloid elements such as Al, Si and Ge may also be present to enhance other properties of the amorphous alloy.

8 Claims, 2 Drawing Figures

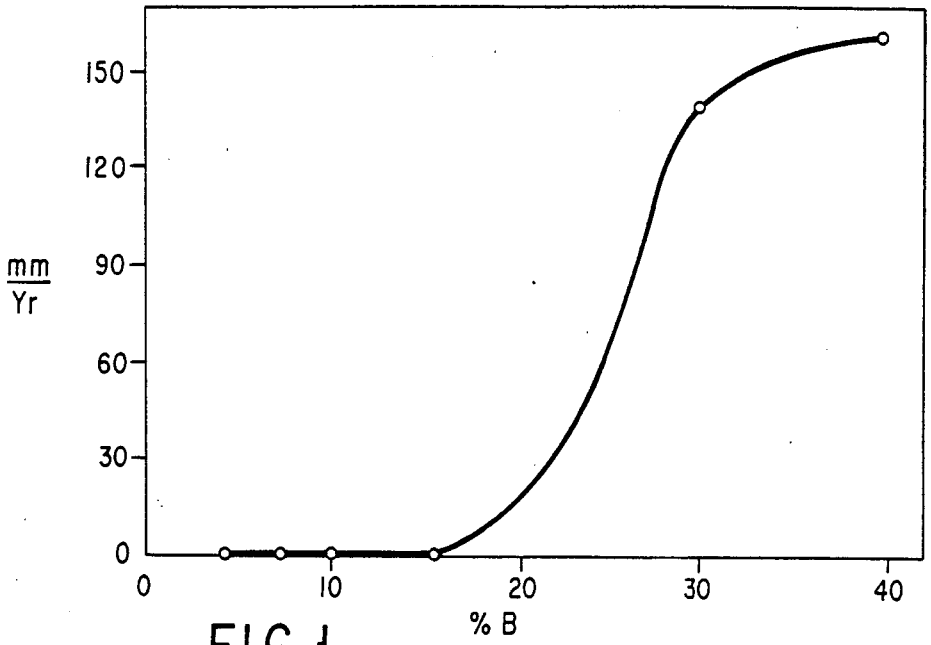
FIG. 1
FIG. 2
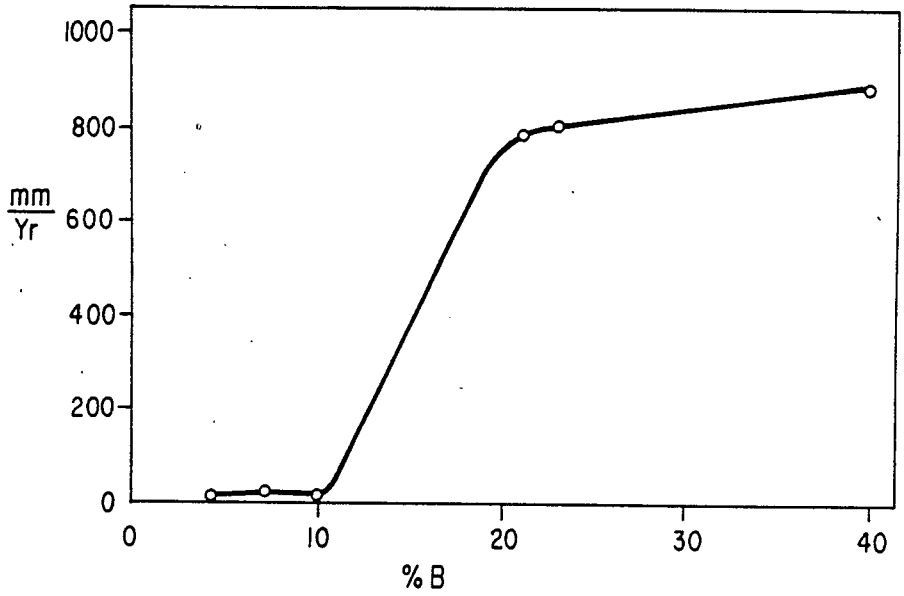

CORROSION RESISTANT AMORPHOUS CHROMIUM-METALLOID ALLOY COMPOSITIONS

FIELD OF THE INVENTION

The present invention relates to amorphous chromium-metalloid alloys that exhibit excellent corrosion resistance in strongly acidic and alkaline environments.

BACKGROUND OF THE INVENTION

The tendency of metals to corrode has long been a recognized concern. By corrosion is meant the degradation of a metal by the environment by either chemical or electrochemical processes. A large number of crystalline alloys have been developed with various degrees of corrosion resistance in response to various environmental conditions on to which the alloys must perform. As examples, stainless steel contains nickel, chromium and/or molybdenum to enhance its corrosion resistance. Glass and metals such as platinum, palladium, and tantalum are also known to resist corrosion in specific environments. The shortcomings of such materials lie in that they are not entirely resistant to corrosion and that they have restricted uses. Tantalum and glass resist corrosion in acidic environments but are rapidly corroded by hydrogen fluoride and strong base solutions.

The corrosion resistance of an alloy is found generally to depend on the protective nature of the surface film, generally an oxide film. In effect, a film of a corrosion product functions as a barrier against further corrosion.

In recent years, amorphous metal alloys have become of interest due to their unique characteristics. While most amorphous metal alloys have favorable mechanical properties, they tend to have poor corrosion resistance. An effort has been made to identify amorphous metal alloys that couple favorable mechanical properties with corrosion resistance. Amorphous ferrous alloys have been developed as improved steel compositions. Binary iron-metalloid amorphous alloys were found to have improved corros!on resistance with the addition of elements such as chromium or molybdenum. M. Naka et al, *Journal of Non-Crystalline Solids,* Vol. 31, page 355, 1979. Naka et al. noted that metalloids such as phosphorus, carbon, boron and silicon added in large percentages to produce the amorphous state, also influenced its corrosion resistance.

T. Masumoto and K. Hashimoto. reporting in the *Annual Review of Material Science.* Vol. 8. page 215, 1978, found that iron, nickel and cobalt-based amorphous alloys containing a combination of chromium, molybdenum, phosphorus and carbon were found to be extremely corrosion resistant in a variety of environments. This has been attributed to the rapid formation of a highly protective and uniform passive film over the homogeneous, single-phase amorphous alloy which is devoid of grain boundaries and most other crystalline defects.

Many amorphous metal alloys prepared by rapid solidification from the liquid phase have been shown to have significantly better corrosion resistance than their conventionally prepared crystalline counterparts. as reported by R. B. Diegle and J. Slater in *Corrosion,* Vol. 32, page 155, 1976. Researchers attribute this phenomena to three factors: Structure, such as grain boundaries and dislocations; chemical composition; and homogeneity, which includes composition fluctuation and precipitates.

Ruf and Tsuei reported amorphous Cr-B alloys having extremely high corrosion resistance, "Extremely High Corrosion Resistance in Amorphous Cr-B Alloys", Journal of Applied Physics. Vol. 54 No. 10, p. 5705, 1983. Amorphous films of Cr-B alloys containing from about 20 to 60 atomic percent boron were formed by rf sputtering. At room temperature, Ruf and Tsuei reported that in 12 N HCl high corrosion resistance was observed only when boron as present in the amorphous alloy at between 20 and 40 atomic percent. Bulk polycrystalline Cr was reported to dissolve at about 700 millimeters/day in 12 N HCl at room temperature.

A thorough discussion of the corrosion properties of amorphous alloys can be found in Glassy Metals: Magnetic, Chemical, and Structural Properties, Chapter 8, CRC Press. Inc., 1983. In spite of advances made to understand the corrosion resistance of amorphous metal alloys, few alloys have been identified that exhibit little or no corrosion under extremely harsh acidic and/or alkaline environments. Those few alloys which do exhibit such properties utilize expensive materials in the alloy composition and so are prohibitive for many applications where their properties are desired.

Amorphous metal alloys that have been studied for corrosion resistance have been evaluated under relatively mild conditions, 1 N–12 N HCl, and at room temperature. However, under more severe conditions, such as 6.5 N HCl at elevated temperatures, those amorphous metal alloys cited as having good corrosion resistance may not be suitable for use.

What is lacking in the field of amorphous metal alloys are economical alloy compositions that exhibit a high degree of corrosion resistance under severely corrosive conditions.

It is, therefore, one object of the present invention to provide amorphous metal alloy compositions having excellent corrosion resistance in acid environments.

It is another object of the invention to provide such amorphous metal alloy compositions in a cost-effective manner.

These and other objects of the present invention will become apparent to one skilled in the art in the following description of the invention and in the appended claims.

SUMMARY OF THE INVENTION

The present invention relates to an amorphous metal alloy of the formula:

$$Cr_{1-x}M_x$$

wherein

M is one element selected from the group consisting of B, C, P, N, S, Sb and As., and when M is B, x ranges from about 0.04 to about 0.16., when M is C, x ranges from about 0.04 to about 0.20., and when M is P, N, S, Sb and As, x ranges from about 0.04 to about 0.30.

The invention also relates to an amorphous metal alloy of the formula:

$$Cr_{1-x}M_x$$

wherein

M is at least two elements selected from the group consisting of B, C, P, N, S, Sb and As; and wherein that portion of x due to B ranges from about 0.04 to about 0.16., that portion of x due to C ranges from about 0.04 to about 0.20., and that portion of x due to P, N, S, Sb and As ranges from about 0.04 to abut 0.30., with the provisos that x ranges from about 0.04 to about 0.30., that portion of x due to M when M is B and/or C and when other M elements are present ranges from about 0.04 to about 0.15.and the ratio of (x due to M when M is B and/or C and when other M elements are present) to (1-x) is less than or equal to 0.5.

The invention also relates to an amorphous metal alloy as described above which additionally includes an element M', wherein M' is at least one element selected from the group consisting of Si, Al and Ge. and wherein M' is present in the alloy in an amount that is less than or equal to 0.5(x), and not greater than 0.10.

DETAILED DESCRIPTION OF THE INVENTION

The compositions described herein are substantially amorphous metal alloys. The term "substantially" is used herein in reference to the amorphous metal alloys indicates that the metal alloys are at least 50 percent amorphous as indicated by X-ray defraction analysis. Preferably, the metal alloy is at least 80 percent amorphous, and most preferably about 100 percent amorphous, as indicated by X-ray defraction analysis. The use of the phrase "amorphous metal alloy" herein refers to amorphous metal-containing alloys that may also comprise non-metallic elements.

In accordance with the present invention there are provided amorphous chromium-metalloid alloy compositions having the ability to withstand corrosion under severely corrosive conditions. These amorphous metal alloys are generally represented by the empirical formula:

$$Cr_{1-x}M_x$$

wherein in one embodiment

M is one element selected from the group consisting of B, C, P, N, S, Sb and As; and when M is B, x ranges from about 0.04 to about 0.16., when M is C, x ranges from about 0.04 to bout 0.20;and when M is P, N, S, Sb and As, x ranges from about 0.04 to about 0.30., and wherein in a second embodiment M is at least two elements selected from the group consisting of B, C, P, N, S, Sb and As; and wherein that portion of x due to B ranges from about 0.04 to about 0.16.

that portion of x due to C ranges from about 0.04 to about 0.20., and that portion of x due to P, N, S, Sb and As ranges from about 0.04 to abut 0.30.

with the provisos that x ranges from about 0.04 to about 0.30;

that portion of x due to M when M is B and/or C and when other M elements are present ranges from about 0.04 to about 0.15; and the ratio of (x due to M when M is B and/or C and when other M elements are present) to (1-x) is less than or equal to 0.5.

Those metalloid elements, M, that have higher relative rates of dissolution result in amorphous chromium-metalloid alloys with higher corrosion resistance. Hence, under similar conditions the corrosion rates of binary chromium-metalloid amorphous alloys may be ranked as follows: Cr-B>Cr-C>Cr-N>Cr-P>Cr-As. Each of these compositions, wherein the chrome-metalloid composition contains a relatively low percentage of the metalloid, exhibit excellent corrosion resistance under severe conditions, that is, a corrosion rate on the order of less than about 20 mm/yr when tested in 6.5 N HCl at 90° C.

The amorphous metal alloy compositions taught herein are different from most amorphous compositions in the literature that claim corrosion resistance in that the compositions herein are conspicuous in the absence of iron, nickel and cobalt as is taught in the literature. However, it is to be recognized that the presence of other elements as impurities in these amorphous metal alloy compositions is not expected to significantly impair the ability of the alloy to resist corrosion. Thus, trace impurities such as O, Te, Si, Al, Ge, Sn and Ar are not expected to be seriously detrimental to the preparation and performance of these materials.

The present invention also contemplates the inclusion of other metalloid elements, identified herein by the symbol M', that, while not significantly contributing to the corrosion resistance of the amorphous alloy, may provide other desirable properties such as wearability, and may contribute to the formation of the amorphous state. Such M' elements include Si, Al and Ge. These M' elements may be present in the amorphous alloy in an amount that is less than or equal to one-half the amount of the M elements in the alloy, but not greater than ten atomic percent.

The corrosion resistance of amorphous chromium-metalloid alloys having significantly higher metalloid contents than those taught herein have been reported as excellent. However, it is shown herein that the greater metalloid content of these disclosed alloys reduces the corrosion resistance of these materials, as compared to those chromium-metalloid alloys disclosed herein. The relative corrosion rates become evident when amorphous chromium-metalloid alloys are subjected to severely corrosive environments.

To insure the desired corrosion resistant properties of the amorphous metal alloy compositions now described, it is important to maintain the integrity of the amorphous state. and so it is not intended that these materials be exposed to an environment wherein the temperature of the alloy may reach or exceed its crystallization temperature.

The substantially amorphous metal alloys taught herein may exist as powders, solids or thin films. The alloys may exist separately or in conjunction with a substrate or other material. A coating of the amorphous metal alloy may be provided onto a substrate to impart the necessary corrosion resistance to the substrate material. Such a physical embodiment of the amorphous metal alloy may be useful as a coating on the interior surface of a chemical reaction vessel, as a coating on structural metal exposed to sea water or other strongly corrosive environments and as a coating on the surface of pipelines and pumps that transport acidic and/or alkaline chemicals. The amorphous metal alloy, because of its inherent hardness, may also be fabricated into any shape, and used freestanding or on a substrate for applications in harsh environments.

The compositions taught herein can be prepared by any of the standard techniques for the synthesis of amorphous metal alloy materials. Thus, physical and chemical methods such as electron beam deposition, chemical reduction, thermal decomposition, chemical vapor deposition, ion cluster deposition, ion plating, liquid quenching, RF and DC sputtering may be utilized to form the compositions herein as well as the chemical vapor deposition method referred to hereinabove.

BRIEF DESCRIPTION OF THE DRAWINGS

The invention will become further apparent from a consideration of the accompanying figures, which are discussed in detail with the following examples, wherein:

FIG. 1 is a graph of the corrosion rates of amorphous Cr-B alloys in 6.5 N HCl at about 70° C. and FIG. 2 is a graph of the corrosion rates of amorphous Cr-B alloys in 6.5 N HCl at about 90° C.

EXAMPLES

The following examples demonstrate the corrosion resistance of various amorphous chromium-metalloid compositions. It is to be understood that these examples are utilized for illustrative purposes only, and are not intended, in any way, to be limitative of the present invention.

The samples described and evaluated below were prepared by RF sputtering in the following manner: A 2" research S-gun manufactured by Sputtered Films, Inc. was employed. As is known, DC sputtering can also be employed to achieve similar results. For each sample a glass substrate was positioned to receive the deposition of the sputtered amorphous metal alloy. The distance between the target and the substrate in each instance was about 10 cm. The thicknesses of the films were measured by a quartz crystal monitor located next to the deposition sight. The average film thickness was about 1000 Angstroms. Confirmation of film thickness was done with a Dektak II, a trade name of the Sloan Company.

Each sample was analyzed by X-ray diffraction to confirm the composition and to verify that the composition was amorphous. Samples to be evaluated at either 70° C. or 90° C. were attached to a flattened glass rod with silicon adhesive, then fully immersed into a magnetically stirred. aqueous environment in which it was to be tested. No attempt was made to remove dissolved oxygen from these solutions. The temperature of each test environment was maintained within ±1° C. of the test temperature. Samples to be evaluated in a refluxing environment (approximately 108° C.) were glued with a silicon adhesive to the bottom disc of a cylindrical reactor fitted with a reflux condenser.

Each sample remained in its test environment for a period of time after which a corrosion rate could be measured. Generally, the alloy composition of each sample was about totally consumed in the test. The time each sample was tested varied as a function of the composition being tested and the test environment. Samples were exposed to the test environments for periods of time ranging from several seconds to several hundred hours.

EXAMPLE 1

In this example a series of six amorphous Cr-B alloys were sublected to a test environment of 6.5 N HCl maintained at about 70° C. The amount of chromium and boron was varied in each alloy, the amount of boron in the alloys ranging from about four atomic percent to about forty atomic percent.

The corrosion rates of these alloys as tested were extrapolated to annual corrosion rates and are presented in FIG. 1. As can be seen from the Figure, the corrosion rates of amorphous chromium-boron alloys wherein boron exists in the alloy in an amount of from about thirty atomic percent to about forty atomic percent is in the range of from about 150 to about 160 mm/year. This corrosion rate compares favorably to the corrosion rate of a polycrystalline chromium film, which under milder conditions of 12 N HCl at room temperature has a corrosion rate of about 5800 mm/year.

When the amorphous chromium-boron alloy contains less than about fifteen atomic percent boron, the corrosion rate of the alloy drops rapidly with reduced boron content to less than 1 mm/yr. In the range of boron content between about four and fifteen atomic percent, the corrosion rates of these chromium-boron alloys range from about $<0.008$ to about 0.65 mm/year.

EXAMPLE 2

A series of six amorphous chromium-boron alloys were tested in an environment of 6.5 N HCl maintained at about 90° C. As in Example 1 above, the amount of boron in these alloys varied from about four atomic percent to about forty atomic percent.

After testing in 6.5 N HCl at about 90° C. for a time sufficient to measure corrosion of the sample, an annual corrosion rate for each sample was calculated and is depicted in the graph in FIG. 2. As can be seen from FIG. 2, the corrosion rates of chromium-boron alloys tested under these conditions vary as a function of the boron content of the alloy. Notably, when the boron content of the binary alloy is less than about ten atomic percent, the alloy exhibits a corrosion rate under these circumstances of less than about twenty mm/yr. When the boron content of the amorphous binary alloy exceeds fifteen atomic percent, then the corrosion rate is significantly higher, in the range of from about 800 mm/yr to about 900 mm/yr for alloys having a boron content between fifteen and forty percent. While the corrosion rates of the amorphous Cr-B binary alloys are significantly lower than that of polycrystalline chromium metal, the corrosion rate is dramatically decreased when the boron content of the chromium-boron alloy is less than fifteen atomic percent.

EXAMPLES 3-10

Several chromium-metalloid compositions were tested under severe environmental conditions of 6.5 N HCl at about 90° C., refluxing (108° C.) 6.5 N HCl, concentrated hydrofluoric acid (50 percent) and/or a 50/50 volume percent solution of concentrated hydrofluoric acid and concentrated nitric acid. These compositions included amorphous chromium-phosphorus and chromium-arsenic binary alloys as well as chromium-metalloid alloys having more than one metalloid element. The results of exposure to these environments is summarized in Table 1 below. A dashed line in the Table indicates that no test was performed.

TABLE 1

| Corrosion Rates of Amorphous Chrome-Metalloid Alloys | | | | | |
|---|---|---|---|---|---|
| | | Corrosion Rate in Test Environment (mm/yr) | | | |
| Example | Composition | 6.5 N HCl 90° C. | 6.5 N HCl refluxing (108° C.) | Concentrated HF Acid (50 Percent) | $HF/HNO_3$ (50/50 weight Percent) |
| 3 | $Cr_{97}P_3$ | — | 0.011 | 0.022 | 0.008 |
| 4 | $Cr_{94}P_6$ | — | 0.011 | 0.006 | 0.008 |
| 5 | $Cr_{88}P_{12}$ | — | 0.015 | 0.005 | 0.012 |
| 6 | $Cr_{75}As_{25}$ | — | <0.005 | 0.009 | 0.019 |
| 7 | $Cr_{70}As_{10}P_{10}B_{10}$ | — | 0.181 | — | — |
| 8 | $Cr_{65}As_{10}P_{10}B_{10}Si_5$ | — | 0.388 | — | — |
| 9 | $Cr_{60}N_{20}C_{10}Si_{10}$ | 0.35 | — | — | — |
| 10 | $Cr_{60}N_{20}Si_{20}$ | 607 | — | — | — |

As can be seen from Examples 3–6 in the Table, binary amorphous chromium-phosphorus and chromium-arsenic alloys exhibit excellent corrosion resistance when subjected to refluxing 6.5 N HCl, concentrated hydrofluoric acid. and a 50/50 volume mixture of concentrated hydrofluoric acid and nitric acid; the corrosion rates in all environments ranging from less than about 0.005 mm/yr to only about 0.022 mm/yr.

Example 7 depicts an amorphous chromium-multimetalloid alloy in accordance with the present invention that, in refluxing 6.5 N HCl, exhibited a corrosion rate of about 0.181 mm/yr.

Example 8 depicts an amorphous chromium-multimetalloid alloy similar to the alloy in Example 7, except that a portion of chromium was replaced with Si, as taught herein. After testing in refluxing 6.5 N HCl, this alloy had a corrosion rate of about 0.388 mm/yr.

Example 9 evaluated an amorphous chromium-multimetalloid alloy that included Si as an M′ element as taught herein. When tested in 6.5 N HCl at about 90° C., this alloy had a corrosion rate of about 0.35 mm/year. A chrome-metalloid alloy having Si as an M′ element therein was also tested in Example 10 in 6.5 N HCl maintained at about 90° C. Si was present in the alloy of Example 10 in an amount of about 20 atom percent which is outside the teaching of this disclosure. The corrosion rate of this alloy was about 607 mm/year, which exceeds the corrosion resistance of the alloy compositions taught herein.

Thus it is seen that the compositions in accordance with the teachings herein exhibit excellent corrosion resistance to severely corrosive environments. The fact that these compositions are amorphous metal alloys also indicates that their mechanical properties are relatively high, and so the compositions should be quite useful in environments in which resistance to both erosion and corrosion is needed. In addition, these compositions do not require the use of precious or semi-precious metals, and so are economically feasible for a wide range of practical applications.

Although several amorphous metal compositions have been exemplified herein, it will readily be appreciated by those skilled in the art that the other amorphous metal alloys encompassed in the teachings herein could be substituted therefore.

It is to be understood that the foregoing examples have been provided to enable those skilled in the art to have representative examples by which to evaluate the invention and that these examples should not be construed as any limitation on the scope of this invention. Inasmuch as the composition of the amorphous metal alloys employed in the present invention can be varied within the scope of the total specification disclosure, neither the particular M or M′ components nor the relative amount of the components in the alloys exemplified herein shall be construed as limitations of the invention.

Thus, it is believed that any of the variables disclosed herein can readily be determined and controlled without departing from the spirit of the invention herein disclosed and described. Moreover, the scope of the invention shall include all modifications and variations that fall within that of the attached claims.

We claim:

1. Amorphous metal alloy of the formula:

ti $Cr_{1-x}M_x$ wherein

M is one element selected from the group consisting of B, C, P, N. S, Sb and As; and when M is B, x ranges from about 0.04 to about 0.16., when M is C, x ranges from about 0.04 to about 0.20, and when M is P, N. S, Sb and As, x ranges from about 0.04 to about 0.30.

2. The amorphous metal alloy in accordance with claim 1 wherein said alloy includes an element M′, wherein M′ is at least one element selected from the group consisting of Si, Al and Ge, and wherein M′ is present in the alloy in an amount that is less than or equal to 0.5(x), and not greater than 0.10.

3. The amorphous metal alloy in accordance with claim 1 wherein said amorphous metal alloy is at least 80 percent amorphous.

4. The amorphous metal alloy in accordance with claim 1 wherein said amorphous metal alloy is about 100 percent amorphous.

5. An amorphous metal alloy of the formula:

$Cr_{1-x}M_x$ wherein

M is at least two elements selected from the group consisting of B, C, P, N, S, Sb and As; and wherein that portion of x due to B ranges from about 0.04 to about 0.16;

that portion of x due to C ranges from about 0.04 to about 0.20; and that portion of x due to P, N, S, Sb and As ranges from about 0.04 to about 0.30;

with the provisos that x ranges from about 0.04 to about 0.30;

that portion of x due to M when M is B and/or C and when other M elements are present ranges from about 0.04 to about 0.15; and the ratio of (x due to M when M is B and/or C and when other M elements are present) to (1-x) is less than or equal to 0.5.

6. The amorphous metal alloy in accordance with claim 5 wherein said alloy includes an element M′, wherein M′ is at least one element selected from the group consisting of Si, Al and Ge, and wherein M′ is present in the alloy in an amount that is less than or equal to 0.5(x), and not greater than 0.10.

7. The amorphous metal alloy in accordance with claim 5 wherein said amorphous metal alloy is at least 80 percent amorphous.

8. The amorphous metal alloy in accordance with claim 5 wherein said amorphous metal alloy is about 100 percent amorphous.

* * * * *